United States Patent [19]

Nagy

[11] 3,979,171

[45] Sept. 7, 1976

[54] CONCRETE PLANK MACHINE WITH WIRE MESH GUIDE

[76] Inventor: Robert H. Nagy, 1720 Arrowhead Court, Brookfield, Wis. 53005

[22] Filed: Nov. 29, 1974

[21] Appl. No.: 528,534

[52] U.S. Cl. ..... 425/64; 425/122; 425/219

[51] Int. Cl.[2] ..... B28B 13/02; B28B 23/06

[58] Field of Search ..... 425/59, 62–65, 425/122, 219, 432, 456, 113; 404/100; 264/33–35

[56] References Cited

UNITED STATES PATENTS

| | | | |
|---|---|---|---|
| 2,878,544 | 3/1959 | Dilday | 425/113 |
| 3,382,304 | 5/1968 | Nagy | 425/130 |
| 3,475,800 | 11/1969 | Jones | 425/432 |
| 3,566,490 | 3/1971 | Nagy | 425/117 |
| 3,647,308 | 3/1972 | Yost | 425/219 |

*Primary Examiner*—Francis S. Husar
*Assistant Examiner*—John McQuade
*Attorney, Agent, or Firm*—Arthur L. Morsell, Jr.

[57] ABSTRACT

A roll of reinforcing wire mesh is mounted behind the last concrete hopper on the frame of a movable concrete plank-laying machine. The wire mesh is guided forwardly between an upper portion of the hopper and the lower end of a concrete-delivering chute so that the concrete passes through the wire mesh and into the hopper. A guiding plate connected to an upright wall of the hopper guides the wire mesh downwardly beneath the hopper where its direction is reversed so that it is laid on the concrete plank while concrete is discharged thereover from the hopper.

5 Claims, 4 Drawing Figures

CONCRETE PLANK MACHINE WITH WIRE MESH GUIDE

BACKGROUND OF THE INVENTION

This invention relates generally to concrete plank machines and more particularly to means for continuously embedding reinforcing wire in concrete planks. A typical prior art concrete plank machine is disclosed in U.S. Pat. No. 3,566,490 to Robert H. Nagy. Such machines include a movable frame carrying several hoppers from which layers of concrete are deposited on a bed to form a multi-layered concrete plank, the last hopper depositing the upper layer of concrete on the concrete plank. For some applications, it has been found desirable to embed reinforcing wire mesh in the concrete plank below the upper layer thereof. The reinforcing wire prevents the concrete from sagging over the voids in the concrete plank and also increases negative transverse bending capabilities. To thus reinforce the concrete plank which is being laid by a plank-laying machine has presented problems, as the reinforcing wire mesh must be fed below the leading edge of the last hopper so that the wire mesh will be covered by the upper layer of the concrete plank. However, there is no space available on the existing machines to mount a roll of wire mesh in front of the last hopper without prohibitively expensive modifications.

SUMMARY OF THE INVENTION

In accordance with this invention, the foregoing difficulty is obviated by mounting a supply of reinforcing wire mesh behind the last hopper and by guiding the wire mesh forwardly between an upper portion of the hopper and a chute through which concrete is fed into the hopper, the concrete passing through the wire mesh. The wire mesh is then guided downwardly beneath the hopper where its direction is reversed and it is then laid in the upper layer of the concrete plank while concrete is being discharged from the hopper to improve the consistency of and to provide for an uninterrupted flow of the middle and top layers as they meet below the hopper.

A general object of the invention is therefore to provide means on a movable plank-laying machine for efficiently delivering wire mesh into position in the plank which is being laid.

A further object of the invention is to provide an arrangement wherein the final hopper serves as a guide for the wire mesh and where the wire mesh improves the flow of the middle and top layers of concrete. This makes it possible to lay acceptable planks with larger voids, which results in weight reduction of 25%, with flat upper surfaces. Without the wire mesh, the concrete would cave in or sag over such larger voids.

A still further object of the invention is to provide means for delivering wire mesh, wherein said means occupies a minimum of space in the length of the plank-laying apparatus.

DESCRIPTION OF THE PREFERRED EMBODIMENTS

Figure 1:
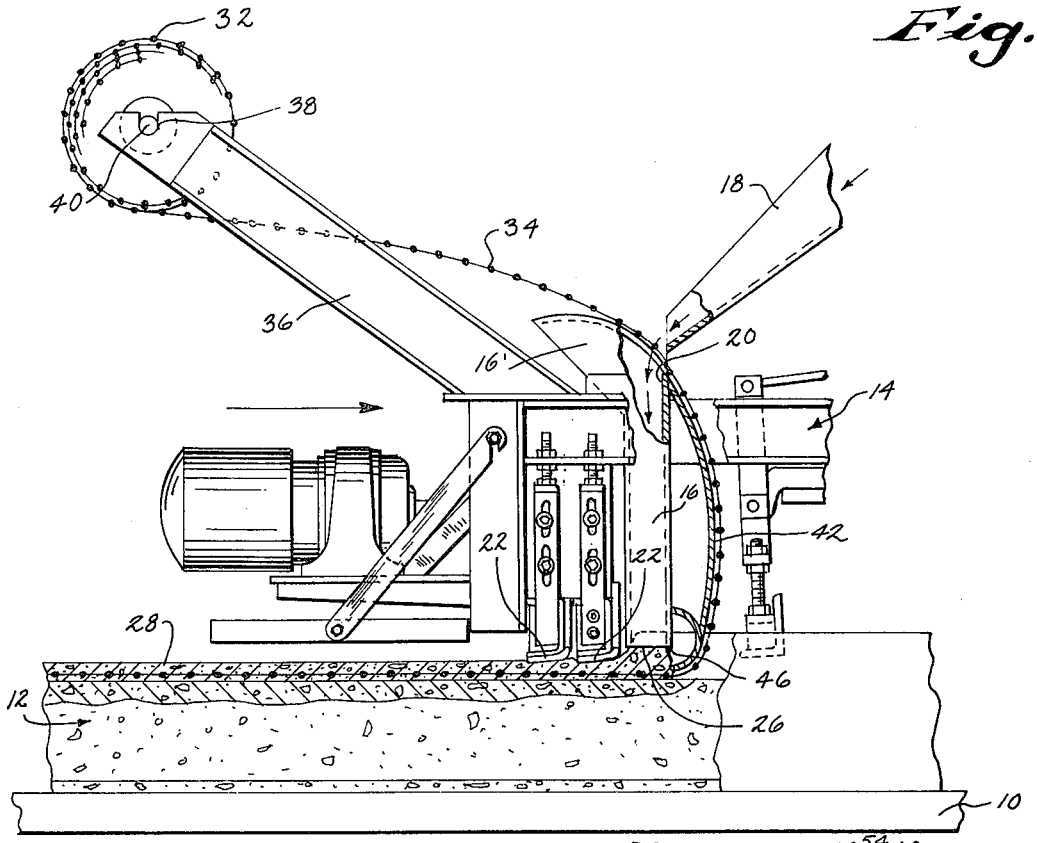
FIG. 1 is a fragmentary side elevational view of the rear portion of a concrete plank machine carrying an embodiment of the reinforcing wire mesh supply means and guide means of this invention.
Figure 2:
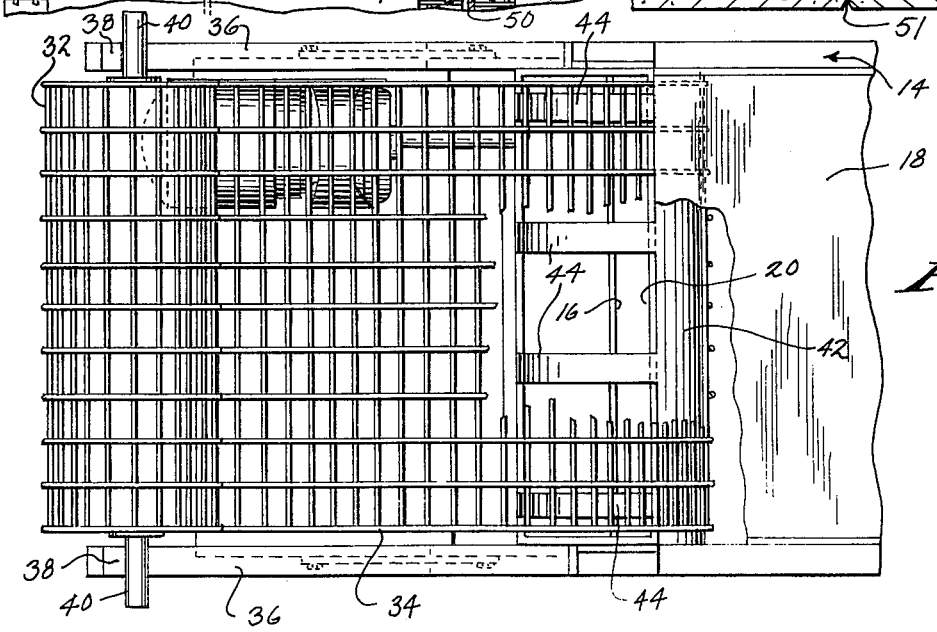
FIG. 2 is a fragmentary plan view, partially cut away, of the apparatus shown in FIG. 1.

FIGS. 1 and 2 show the rear portion of a concrete plank machine equipped with the novel apparatus for embedding reinforcing wire mesh into the concrete plank below the upper layer thereof. The disclosure includes a bed 10 upon which a multi-layer concrete plank 12 is laid, and a frame 14 which is suitably mounted for movement longitudinally of the bed 10 by conventional means not shown. The forward portion of the frame 14, which is not shown in the drawings, includes several concrete hoppers (not shown) which may deposit the lower and intermediate layers 8 and 9 of concrete plank 12 in the general manner shown and described in U.S. Pat. No. 3,566,490 to Robert H. Nagy. The last hopper 16 of the machine extends transversely of the frame as is shown in FIG. 2 positioned below a chute 18 supported on and extending transversely across the frame as shown in FIG. 2, adapted to receive concrete from a suitable supply hopper (not shown) and deliver it into the open top 20 of hopper 16. The concrete deposited in hopper 16 is subsequently discharged from the lower end 26 onto concrete plank 12 to form the upper layer 28 thereof. Two reciprocating trowels 22 may be mounted on frame 14 immediately behind hopper 16 and are activated by suitable means to trowel the top layer 28 of concrete being discharged from the bottom 26 of hopper 16.

The entire frame 14 and all of the elements attached thereto are moved by conventional means, not shown, in the direction of the arrow in FIG. 1 in the course of manufacturing the concrete plank 12. Suitable finishing plates (not shown) may be attached to frame 14 behind trowels 22.

The general object of this invention is to provide means for continuously feeding and embedding reinforcing wire mesh into suitable position in the concrete plank 12, preferably near the bottom of the top layer 28 thereof, with the feed of the mesh pulling the concrete rearwardly underneath the hopper and trowels to improve the flow of the middle and top layers of concrete. This reinforcing wire mesh prevents the concrete from sagging over the voids in the concrete plank and also increases transverse negative bending capabilities which is particularly important when there are extra large voids. In present day concrete plank machines there is insufficient space to install a roll of reinforcing wire mesh in front of the last hopper 16 without prohibitive modifications in the machine. However, in accordance with this invention, a roll of reinforcing wire mesh 32 is mounted in an unusual manner on frame 14 a substantial distance to the rear of hopper 16. With this novel arrangement the wire mesh 34 is guided between the bottom of chute 18 and the top 20 of the back wall of hopper 16, in a position where the concrete entering the hopper 16 passes through wire mesh 34.

The roll 32 of wire mesh 34 is supported by two diagonal beams 36 which are attached to frame 14 at their lower ends and are notched at their upper ends at 38 to rotatably receive the core 40 of roll 32.

A curved guide plate 42 which is cut out at its upper portion to leave laterally-spaced guiding bands 44 (FIG. 2), is attached to the front of hopper 16 and extends from the top 20 to the bottom 26 thereof. Guide plate 42 and guide bands 44 are curved to smoothly lead wire mesh 34 forwardly over the top 20 of back wall of hopper 16, under chute 18, then downwardly in front of hopper 16, and finally rearwardly under the leading edge 46 of the bottom 26 of hopper 16. This places the reinforcing wire mesh 34 below the upper layer 28 of concrete plank 12 as it is being laid. The force required to feed wire mesh 34 under hopper 16 at the proper speed is derived from the movement of frame 14 over the stationary bed 10 and concrete plank 12 thereon. The concrete layer 28 on top of wire mesh 34 is sufficiently compacted by trowels 22 to prevent wire mesh 34 from being pulled out of concrete plank 12 by the motion of frame 14, which therefore only serves to unroll the wire mesh roll 32. Improved results are obtained by having the mesh unroll from the bottom of roll 32 as shown in FIG. 1. This eliminates any kinking tendencies of the mesh after it has been laid in the plank.

Although any size wire mesh whose openings are large enough to pass concrete can be used in this invention, it has been found that a mesh made of 12½ gauge wire with individual rectangular openings 2 inches long and 4 inches wide gives good results and is preferred for most uses.

Figure 3:
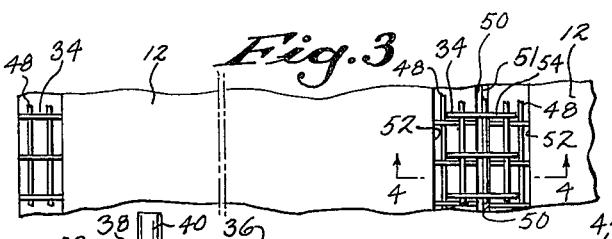
FIG. 3 is a fragmentary plan view of a modification and illustrating adjacent concrete planks where the reinforcing wire mesh projects beyond the side margins of the planks and is overlapped when the planks are laid side by side, whereby grouting between the adjacent planks may interlock with the overlapped mesh to rigidly join the planks together.
Figure 4:
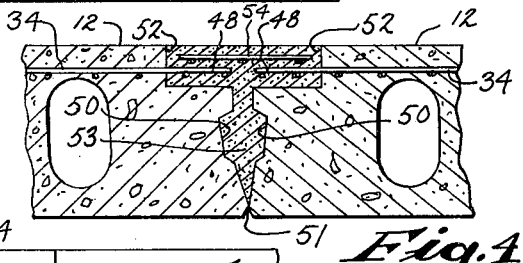
FIG. 4 is a sectional view taken on the line 4—4 of FIG. 3.

The reinforcing wire mesh 34 shown in FIGS. 1 and 2 is slightly narrower than the concrete plank 12 within which it is embedded. If desired, however, wire mesh 34 which is wider than the concrete plank 12 may be used. Inasmuch as the funnel-shaped sides 16' terminate to match the curvatures of the bands 44, there is no problem in having the mesh project laterally. In this case the planks should have tapered sides 50 as shown in FIG. 4 so that they meet at the bottom as at 51, with the sides diverging upwardly to meet specially-formed longitudinal notches 52. In this type of construction the mesh projects into the notches as shown in FIGS. 3 and 4 at numeral 48, there being a strip of mesh 54 overlapping the mesh edges 48. The space between planks as well as the notches 52 is subsequently filled with grout 53 to solidly join the adjacent side edges of the planks and the mesh together in a construction that is strong enough to resist breakage during an earthquake. This construction is very desirable in any region that is subject to earthquakes.

Various changes and modifications may be made without departing from the spirit of the invention, and all of such changes are contemplated as may come within the scope of the claims.

What is claimed is:

1. In a movable machine for manufacturing concrete planks by the discharge of concrete onto a bed, said machine having a frame, having means including at least one hopper mounted on the frame to extend transversely thereof for discharging concrete which is to form the plank structure onto said bed, and having a chute supported on the frame in a position to extend transversely of the frame over said hopper and direct concrete into said hopper, the improvement comprising means on said frame in trailing relationship with said hopper for supporting a supply of reinforcing wire mesh, means on said frame for guiding said wire mesh from said supply between said chute and said hopper in a position where the concrete from the chute passes through said wire mesh into the hopper substantially throughout the length of the hopper, said guiding means being positioned to direct the wire mesh downwardly in a position in advance of the hopper and then in a reverse direction beneath said hopper in a position where it is laid on the plank which is being formed while additional concrete is discharged thereover from the hopper.

2. In a movable machine for manufacturing concrete planks by the discharge of concrete onto a bed, said machine having a frame, having means including at least one hopper mounted on the frame for discharging concrete which is to form the plank structure onto said bed, and having a chute supported on said frame in a position to direct concrete into said hopper, the improvement comprising means on said frame for supporting a supply of reinforcing wire mesh, means for guiding said wire mesh from said supply between said chute and said hopper in a position where the concrete from the chute passes through said wire mesh into the hopper, said guiding means being positioned to direct the wire mesh beneath said hopper in a position where it is laid on the plank which is being formed while additional concrete is discharged thereover from the hopper, said guiding means comprising a curved plate attached to the front of said hopper and having means extending rearwardly over the top of said hopper to guide said wire mesh thereover while permitting concrete to pass through.

3. The apparatus of claim 2 wherein the lower portion of said curved plate is curved rearwardly to guide said wire mesh beneath the bottom of said hopper.

4. The apparatus of claim 2 in which the means extending rearwardly over the top of the hopper is a plurality of spaced bands projecting from the upper end of said curved plate.

5. The apparatus of claim 4 wherein the lower portion of said curved plate is curved rearwardly to guide said wire mesh beneath the bottom of said hopper.

* * * * *